US011179746B2

(12) United States Patent
Bosmans et al.

(10) Patent No.: US 11,179,746 B2
(45) Date of Patent: Nov. 23, 2021

(54) VEHICLE BODY PART AND METHOD OF FORMING A VEHICLE BODY PART

(71) Applicants: TOYOTA MOTOR EUROPE, Brussels (BE); HENKEL AG & CO. KGAA, Düsseldorf (DE)

(72) Inventors: Johan Bosmans, Brussels (BE); Junya Ogawa, Brussels (BE); Gloria Castrillo Clemente, Brussels (BE); Nadine Bederke, Nussloch (DE); Wolfgang Johann, Gau-Angelloch (DE); Thorsten Neeb, Freimersheim (DE)

(73) Assignees: TOYOTA MOTOR EUROPE, Brussels (BE); HENKEL AG & CO. KGAA, Düsseldorf (DE)

( * ) Notice: Subject to any disclaimer, the term of this patent is extended or adjusted under 35 U.S.C. 154(b) by 92 days.

(21) Appl. No.: 16/324,899

(22) PCT Filed: Aug. 10, 2016

(86) PCT No.: PCT/EP2016/069088
§ 371 (c)(1),
(2) Date: Feb. 11, 2019

(87) PCT Pub. No.: WO2018/028785
PCT Pub. Date: Feb. 15, 2018

(65) Prior Publication Data

US 2019/0358670 A1 Nov. 28, 2019

(51) Int. Cl.
*B05D 7/00* (2006.01)
*B05D 7/14* (2006.01)

(52) U.S. Cl.
CPC ..... *B05D 7/542* (2013.01); *B05D 7/14* (2013.01); *B05D 7/577* (2013.01);
(Continued)

(58) Field of Classification Search
None
See application file for complete search history.

(56) References Cited

U.S. PATENT DOCUMENTS 5,389,406 A 2/1995 Doebler et al.
5,464,888 A 11/1995 Owen
(Continued)

FOREIGN PATENT DOCUMENTS

EP 0 845 303 A2 6/1998
JP 2014-028332 A 2/2014

OTHER PUBLICATIONS

May 2, 2017 International Search Report issued in International Patent Application No. PCT/EP2016/069088.
(Continued)

*Primary Examiner* — Shamim Ahmed
*Assistant Examiner* — Bradford M Gates
(74) *Attorney, Agent, or Firm* — Oliff PLC

(57) ABSTRACT

A vehicle body part including a support, an uncured sealer and an uncured primer, the uncured sealer being interposed between the support and the uncured primer, the uncured sealer and the uncured primer each including a compatible solvent, each compatible solvent having a log $P_{ow}$ value and an absolute value of a difference between the log $P_{ow}$ value of the compatible solvent of the uncured primer and the compatible solvent of the uncured sealer being equal to or smaller than 3.0. A method of forming a finished vehicle body part.

10 Claims, 2 Drawing Sheets

(52) U.S. Cl.
CPC ..... *B05D 2202/15* (2013.01); *B05D 2252/10* (2013.01); *B05D 2350/60* (2013.01)

(56) References Cited

U.S. PATENT DOCUMENTS

| | | | | |
|---|---|---|---|---|
| 2003/0008934 | A1 | 1/2003 | Zychowski et al. | |
| 2005/0082810 | A1* | 4/2005 | Chou | B62D 25/2072 280/770 |
| 2005/0249954 | A1 | 11/2005 | Kawaguchi et al. | |
| 2006/0188735 | A1* | 8/2006 | Reising | C09D 167/00 428/458 |
| 2006/0234036 | A1 | 10/2006 | December et al. | |
| 2006/0270778 | A1* | 11/2006 | Sophiea | C08L 75/04 524/500 |
| 2011/0291429 | A1 | 12/2011 | Anderson, Jr. et al. | |
| 2012/0027938 | A1* | 2/2012 | Kitamura | C09D 5/4438 427/372.2 |

OTHER PUBLICATIONS

Apr. 30, 2021 Office Action issued Chinses Patent Application No. 201680087923.2.

* cited by examiner

VEHICLE BODY PART AND METHOD OF FORMING A VEHICLE BODY PART

FIELD OF THE DISCLOSURE

The present disclosure is related to a vehicle body part, and more particularly to the coating of a vehicle body part.

BACKGROUND OF THE DISCLOSURE

Vehicle body parts made of metallic plates, such as steel or aluminum, are coated to protect the parts from corrosion for example and to make the vehicle looks nice.

The vehicle body parts are generally coated with several coatings.

First, an electrodeposition coating is applied. The electrodeposition coating allows coating of the inside of the vehicle body which may prove difficult to coat by spray-coating. The electrodeposition coating imparts rust resistance and chipping resistance to the vehicle body part.

A sealer is applied on the electrodeposited part, for example at the openings of the vehicle body parts, to prevent water from entering into the finished vehicle.

Then, a primer coating is applied. A base coat and a clear coat may then be applied.

Generally, between each applied coat, the vehicle body part is cured. The curing steps are generally performed at temperatures comprised between 60° C. (degree Celsius) and 180° C. In view of reducing the energy consumption and the carbon emission, it is sought to reduce the temperature and time of these curing steps and even to reduce the number of curing steps.

Thus, it has been proposed to apply the primer on the uncured sealer, this technique is also known as "wet-on-wet" technique, as the sealer is not dried before applying the primer. However, crawling of the primer may occur. This phenomenon is also known as "paint crawling" and is not acceptable.

This phenomenon is attributed to the composition of the sealer and in particular to the plasticizer comprised in the sealer. To solve the problem, the composition of the primer is generally modified as the composition of the plasticizer itself is very difficult to modify. However, this approach is very complicated and demanding.

SUMMARY OF THE DISCLOSURE

Currently, it remains desirable, to apply the primer on the uncured sealer. For example, the inventors of the present application have recognized that it is desirable to reduce the number of curing steps and to avoid crawling phenomena of the primer on the sealer.

Therefore, according to embodiments of the present disclosure, a vehicle body part is provided. The vehicle body part includes a support, an uncured sealer and an uncured primer, the uncured sealer being interposed between the support and the uncured primer, the uncured sealer and the uncured primer each comprising a compatible solvent, each compatible solvent having a log $P_{ow}$ value and an absolute value of a difference between the log $P_{ow}$ value of the compatible solvent of the uncured primer and the compatible solvent of the uncured sealer being equal to or smaller than 3.0.

By providing such a configuration, it is possible to apply the uncured primer on the uncured sealer and to avoid crawling phenomena of the primer on the sealer.

By compatible solvent of the uncured primer, it is intended a solvent that does not damage the uncured primer. By compatible solvent of the uncured sealer, it is intended a solvent that does not damage the uncured sealer. Typically, some solvent may cut the polymer chains in the uncured sealer, in particular the polymer chains of the plasticizer and thus, damage the plasticizer and the uncured sealer. Once cured, the cured sealer would therefore no longer be capable of preventing water to enter the finish car.

The inventors have identified that other parameters than the compatibility between the primer and the chemical composition of the plasticizer may influence the behaviour of the uncured primer on the uncured sealer.

The log $P_{ow}$ is the logarithmic value of the partition coefficient P. The partition coefficient P is the ratio of the concentrations of a solute between two solvents. The subscript "o" stands for octanol and the subscript "w" stands for water.

One method of measuring the distribution coefficient P is the so-called "shake-flask method", which consists of dissolving some of the solute in a volume of octanol and water at 20° C., then measuring the concentration of the solute in each solvent. A method for measure the concentration of the solute in each solvent may be for example UV/VIS spectroscopy. For example, toluene has a log $P_{ow}$ value of 2.8 at 20° C.

In particular, they have identified that the crawling phenomena may be reduced or even avoided when the log $P_{ow}$ value of the compatible solvent of the primer and the compatible solvent of the sealer are relatively close to each other, i.e., the absolute value of a difference between the log $P_{ow}$ value of the compatible solvent of the primer and the compatible solvent of the sealer being equal to or smaller than 3.0.

When the solvent of the uncured sealer and the solvent of the uncured primer have log $P_{ow}$ values which are too far away from each other, when phenomenon such as bleeding of the solvent out of the uncured plasticizer occurs, there are de-wetting phenomena or crawling phenomena taking place on the surface of the sealer due to incompatibility between the solvent of the uncured sealer and the solvent of the uncured primer.

These phenomena may typically occur during a curing step performed after applying the uncured sealer and the uncured primer. They may also occur when the uncured sealer and uncured primer are let in the open air at room temperature for a certain period of time, for example for two days. The kinetic of such phenomena may vary and depends in particular on the solvents, the temperature, the humidity, etc.

On the contrary, when the solvent of the uncured sealer and the solvent of the uncured primer have log $P_{ow}$ values which are relatively close to each other, the solvent of the uncured sealer may dissolve in the uncured primer and no de-wetting phenomena are observed.

Thus, it is possible to reduce the number of curing steps when making a vehicle body part. It is therefore possible to reduce the amount of energy spent, the amount of carbon emission as well as to reduce the production time of a vehicle body part.

The absolute value of the difference between the log $P_{ow}$ value of the compatible solvent of the uncured primer and the compatible solvent of the uncured sealer may be equal to or smaller than 2.5.

The absolute value of the difference between the log $P_{ow}$ value of the compatible solvent of the uncured primer and the compatible solvent of the uncured sealer may be equal to or smaller than 2.0.

The absolute value of the difference between the log $P_{ow}$ value of the compatible solvent of the uncured primer and the compatible solvent of the uncured sealer may be greater than or equal to 0.1.

The compatible solvent of the primer may be different from the compatible solvent of the sealer.

A compatible solvent may be a mixture of solvents.

When there is a mixture of solvents, the absolute value of a difference between the log $P_{ow}$ value of the compatible solvent of the primer and the compatible solvent of the sealer may be equal to or smaller than 3.0. preferably equal to or smaller than 2.5, more preferably equal to or smaller than 2.0 for each solvent of the mixture of solvents.

The absolute value of the difference between the log $P_{ow}$ value of the compatible solvent of the uncured primer and the compatible solvent of the uncured sealer may be greater than or equal to 0.1 for each solvent of the mixture of solvents.

Thus, it is not the average value of the log $P_{ow}$ value of the solvents of the mixture of solvents that is taken into account but the individual log $P_{ow}$ value of each solvent in the mixture of solvents.

In one embodiment it might be preferred that the sealer or the primer or both contain each only one compatible solvent.

The amount of solvent in the sealer may be smaller than or equal to 10.0 wt %, preferably smaller than or equal to 7.0 wt %, more preferably smaller than or equal to 5.0 wt % and greater than or equal to 0.1 wt %, preferably greater than or equal to 0.2 wt %, more preferably greater than or equal to 0.5 wt %. Except otherwise specified, the amount in wt % is referring to the total amount of the respective composition, like here referring to the total amount of the sealer composition.

The amount of solvent in the primer may be greater than or equal to 30.0 wt %, preferably greater than or equal to 50.0 wt %, preferably greater than or equal to 70.0 wt %. The amount of solvent in the primer may be smaller than or equal to 95.0 wt %.

The present disclosure also relates to a method of forming a finished vehicle body part having a support comprising the steps of:

applying an uncured sealer on the support; and applying an uncured primer on the uncured sealer, so as to form the vehicle body part as defined above.

After applying the uncured primer, a curing step may be performed.

A cured electrodeposition coating may have been applied on the support before applying the uncured sealer.

The method may comprise a step of applying a base coat.

The method may comprise a step of applying a clear coat on the base coat.

After applying the base coat, a pre-heating step may be performed.

After applying the clear coat, a curing step may be performed.

It is intended that combinations of the above-described elements and those within the specification may be made, except where otherwise contradictory.

It is to be understood that both the foregoing general description and the following detailed description are exemplary and explanatory only and are not restrictive of the disclosure, as claimed.

The accompanying drawings, which are incorporated in and constitute a part of this specification, illustrate embodiments of the disclosure and together with the description, serve to explain the principles thereof.

DESCRIPTION OF THE EMBODIMENTS

Reference will now be made in detail to exemplary embodiments of the disclosure, examples of which are illustrated in the accompanying drawings. Wherever possible, the same reference numbers will be used throughout the drawings to refer to the same or like parts.

Figure 1:
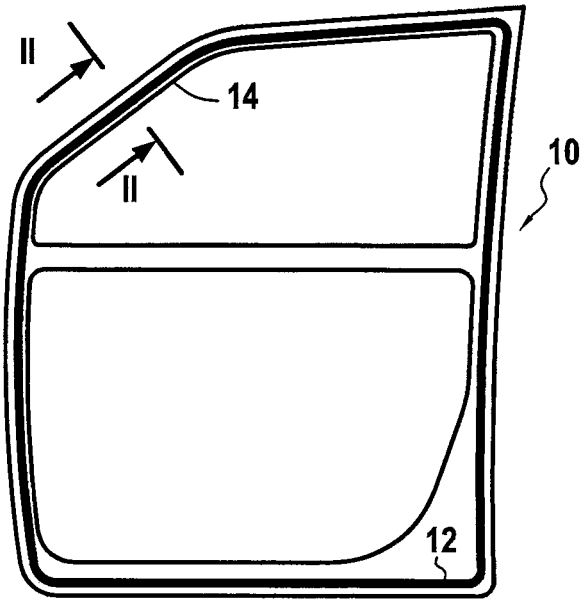
FIG. 1 shows an exemplary vehicle body part with a sealer.

FIG. 1 shows a representation of an exemplary vehicle body part according to embodiments of the present disclosure, in this example a door 10. The door 10 comprises an uncured sealer 12 applied to prevent water to enter the finished vehicle. As can be seen on FIG. 1, the uncured sealer 12 is applied close to the inner periphery of the door 10.

Figure 2:
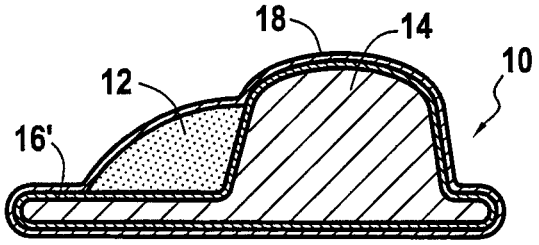
FIG. 2 shows a cross-section of the exemplary vehicle body part with the sealer and a primer uncured taken along II-II of FIG. 1.

FIG. 2 shows a cross-section of the exemplary vehicle body part 10 of FIG. 1 comprising a support 14 of the vehicle body part 10. The support 10 is typically made of metal, such as steel or aluminum. The support 14 is covered with a cured electrodeposition layer 16' on which the uncured sealer 12 has been applied. The vehicle body part 10 also comprises an uncured primer 18 applied on the uncured sealer 12. Thus, the uncured sealer 12 is interposed between the support 14, through the cured electrodeposition layer 16', and the uncured primer 18. Some of the uncured primer 18 is directly applied on the cured electrodeposition layer 16', no uncured sealer being interposed between the support 14, through the cured electrodeposition layer 16', and the uncured primer 18.

Figure 3:
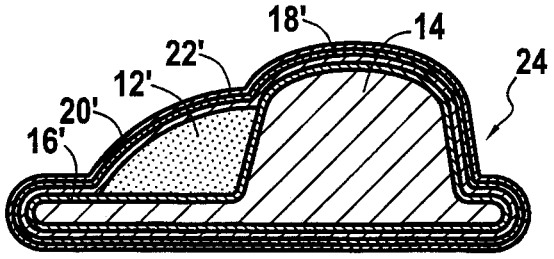
FIG. 3 shows a cross-section of the exemplary finished vehicle body part taken along II-II of FIG. 1.

FIG. 3 shows a cross-section of an exemplary finished vehicle body part 24 comprising the support 14, the cured electrodeposition layer 16', the cured sealer 12', the cured primer 18', a cured base coat 20' applied on the cured primer 18' and a cured clear coat 22' applied on the cured base coat 20'.

An exemplary method of forming the finished vehicle body part 24 is as follows. At step 30, an electrodeposition layer is deposited on the support 14 and then cured to form the electrodeposition layer 16'. At step 32, the uncured sealer 12 is applied on the support 14 coated with the cured electrodeposition layer 16'. At step 34, the uncured primer 18 is applied on the support 14 coated with the cured electrodeposition layer 16' and the uncured sealer 12. Thus, the uncured primer 18 is applied on both the uncured sealer 12 and the cured electrodeposition layer 16'. At step 36, a first curing step is performed, for example at temperature above 100° C., preferably at 140° C. for more than 10 min.

(minutes) so as to cure the uncured sealer 12 and the uncured primer 18, forming a cured sealer 12' and a cured primer 18'. Then, at step 38, an uncured base coat is applied and cured at step 40 so as to form a cured base coat 20'. At step 42, an uncured clear coat is applied over the cured base coat 20' and cured at step 44 so as to form a cured clear coat 22' and obtain the finished vehicle body part 24.

It is to be understood that the curing steps 36, 40 and 44 may or not may be performed.

Figure 4:
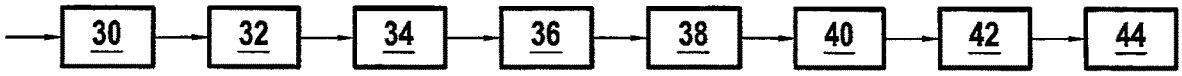
FIG. 4 shows a block diagram illustrating an exemplary method according to embodiments of the present disclosure.

As can be seen on FIG. 4, there is no curing step performed between steps 32 and 34.

Typically, the uncured sealer 12 comprises a plasticizer, preferably 15-50 wt %, more preferably 25-35 wt %. It also comprises a compatible solvent 26, for example at around 4 wt %, as well as a filler, preferably 20-50 wt %, more preferably 30 to 40 wt %, such as calcium carbonate ($CaCO_3$).

Typically, the uncured primer 18 comprises mainly a resin, such as a polyester resin, a polyacrylic resin or a melamine resin. It also comprises a compatible solvent, additives such as surface control agent and/or rheology control agent, and pigments such as titanium oxide ($TiO_2$) or carbon black. Examples of solvent are, but are not limited to, toluene, xylene, methanol, butanol, naphtha solvent, and mixture thereof.

Thus, samples are made by applying a layer of plasticizer mixed with the compatible solvent of the plasticizer on a metallic plate coated with a cured electrodeposition layer 16'. Then, the primer is applied on the uncured plasticizer, let to rest at least 3 min., preferably at least 7 min., and then cured at 140° C. for 18 min.

Figure 5A:
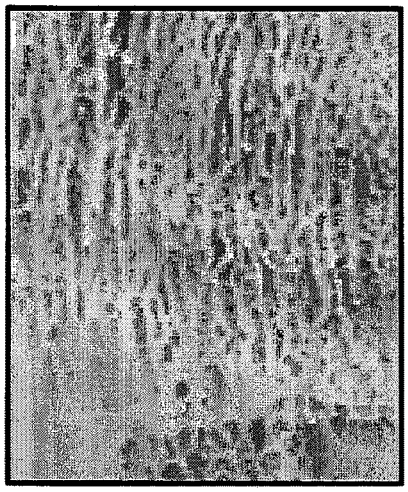
FIGS. 5A and 5B show a vehicle body part after curing of the sealer and the primer.

FIG. 5A is a test sample where the log $P_{ow/primer}$ value of the compatible solvent of the primer is equal to 3.0 and the log $P_{ow/sealer}$ value of the compatible solvent of the sealer is equal to 7.5. As can be seen, crawling of the primer on the sealer occurs.

In the test sample of FIG. 5A, the absolute value of a difference between the log $P_{ow}$ value of the compatible solvent of the primer and the compatible solvent of the sealer is equal to 4.5. Thus, the absolute value of a difference between the log $P_{ow}$ value of the compatible solvent of the primer and the compatible solvent of the sealer is greater than 3.0.

Figure 5B:
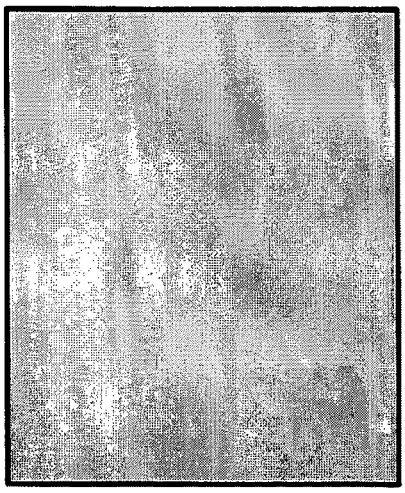

FIG. 5B is a test sample where the log $P_{ow/primer}$ value of the compatible solvent of the primer is equal to 3.0 and the log $P_{ow/sealer}$ value of the compatible solvent of the sealer is equal to 5.0. As can be seen on FIG. 5B, no crawling of the primer on the sealer occurs.

In the test sample of FIG. 5B, the absolute value of a difference between the log $P_{ow}$ value of the compatible solvent of the primer and the compatible solvent of the sealer is equal to 2.0. Thus, the absolute value of a difference between the log $P_{ow}$ value of the compatible solvent of the primer and the compatible solvent of the sealer is smaller than 3.0, even smaller than 2.5 and equal to 2.0.

Figure 6:
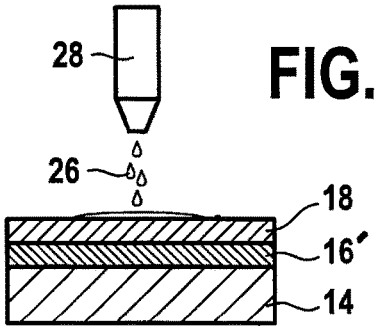
FIG. 6 shows a test method for determining the compatibility of the solvent of the sealer with the primer.

Another experiment is shown on FIG. 6. The metallic part 14 coated with the cured electrodeposition layer 16' is coated with the uncured primer 18. Then, the compatible solvent 26 of the uncured sealer 12 is dropped on the uncured primer 18. The compatible solvent 26 spreads over the uncured primer 18.

When, the absolute value of a difference between the log $P_{ow}$ value of the compatible solvent of the primer and the compatible solvent of the sealer is smaller than or equal to 3.0, the compatible solvent 26 dissolves in the uncured primer 18.

When, the absolute value of a difference between the log $P_{ow}$ value of the compatible solvent of the primer and the compatible solvent of the sealer is greater than 3.0, the compatible solvent 26 does not dissolves in the uncured primer 18.

Throughout the description, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Where any standards of national, international, or other standards body are referenced (e.g., ISO, etc.), such references are intended to refer to the standard as defined by the national or international standards body as of the priority date of the present specification. Any subsequent substantive changes to such standards are not intended to modify the scope and/or definitions of the present disclosure and/or claims.

Although the present disclosure herein has been described with reference to particular embodiments, it is to be understood that these embodiments are merely illustrative of the principles and applications of the present disclosure. It is understood that the present disclosure is not only meant for a door 10. It may encompass any vehicle body part, such as a frame, a hood, etc.

It is intended that the specification and examples be considered as exemplary only, with a true scope of the disclosure being indicated by the following claims.

The invention claimed is:

1. A vehicle body part comprising
a support,
an uncured sealer, and
an uncured primer, wherein
the vehicle body part is a door or a hood,
the uncured sealer is interposed between the support and the uncured primer,
the uncured sealer and the uncured primer each comprise a compatible solvent,
each compatible solvent has a log $P_{ow}$ value, and
an absolute value of a difference between the log $P_{ow}$ value of the compatible solvent of the uncured primer and the compatible solvent of the uncured sealer being equal to or smaller than 3.0; where
the uncured sealer comprises 15-50 wt % of plasticizer, and
the door or the hood has an opening, a strip of the uncured sealer being applied at the opening of the door or the hood to prevent water from entering into a finished vehicle that includes the door or the hood.

2. The vehicle body part according to claim 1, wherein the absolute value of the difference between the log $P_{ow}$ value of the compatible solvent of the uncured primer and the compatible solvent of the uncured sealer being equal to or smaller than 2.5.

3. The vehicle body part according to claim 2, wherein the absolute value of the difference between the log $P_{ow}$ value of the compatible solvent of the uncured primer and the compatible solvent of the uncured sealer being equal to or smaller than 2.0.

4. A method of forming a finished vehicle body part having a support comprising the steps of:

applying an uncured sealer on the support; and applying an uncured primer on the uncured sealer, so as to form the vehicle body part according to claim 1.

5. The method according to claim 4, wherein after applying the uncured primer, a curing step is performed.

6. The method according to claim 4, wherein a cured electrodeposition coating has been applied on the support before applying the uncured sealer.

7. The method according to claim 4, comprising a step of applying a base coat.

8. The method according to 7, comprising a step of applying a clear coat on the base coat.

9. The method according to claim 7, wherein after applying the base coat, a curing step is performed.

10. The method according to claim 8, wherein after applying the clear coat, a curing step is performed.

* * * * *